US011395387B2

(12) United States Patent
Benner et al.

(10) Patent No.: US 11,395,387 B2
(45) Date of Patent: Jul. 19, 2022

(54) LED LAMP WITH SELECTABLE COLOR TEMPERATURE OUTPUT

(71) Applicant: Current Lighting Solutions, LLC, East Cleveland, OH (US)

(72) Inventors: Kevin Jeffrey Benner, Solon, OH (US); Bruce Richard Roberts, Mentor-on-the-Lake, OH (US); Kevin James Vick, Avon, OH (US)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 15/981,604

(22) Filed: May 16, 2018

(65) Prior Publication Data

US 2019/0357329 A1 Nov. 21, 2019

(51) Int. Cl.
*H05B 45/20* (2020.01)

(52) U.S. Cl.
CPC ..... *H05B 45/20* (2020.01)

(58) Field of Classification Search
CPC ..... F21Y 2115/10; F21Y 2113/13; H05B 33/0806; H05B 33/0809; H05B 33/0815; H05B 33/0821; H05B 33/083; H05B 33/0845; H05B 33/0857; H05B 33/086; H05B 33/0863; H05B 35/00; H05B 41/2885; H05B 41/46
USPC ..... 315/185 R, 185 S, 90, 130, 178, 179, 315/182, 188
See application file for complete search history.

(56) References Cited

U.S. PATENT DOCUMENTS

| | | | | |
|---|---|---|---|---|
| 6,234,645 | B1 | 5/2001 | Börner et al. | |
| 6,234,648 | B1 | 5/2001 | Börner et al. | |
| 6,513,949 | B1 | 2/2003 | Marshall et al. | |
| 6,636,003 | B2 | 10/2003 | Rahm et al. | |
| 6,692,136 | B2 | 2/2004 | Marshall et al. | |
| 7,014,336 | B1 | 3/2006 | Ducharme et al. | |
| 7,525,248 | B1 * | 4/2009 | Fan | H01L 25/0753 313/506 |
| 7,719,209 | B2 | 5/2010 | Hayes | |
| 8,203,260 | B2 | 6/2012 | Li et al. | |
| 8,203,284 | B2 | 6/2012 | Peeters et al. | |
| 8,436,549 | B2 | 5/2013 | Hasnain | |
| 9,615,420 | B2 * | 4/2017 | Miskin | H05B 45/37 |
| 2009/0184616 | A1 * | 7/2009 | Van De Ven | H05B 33/086 313/1 |
| 2010/0141161 | A1 * | 6/2010 | Hering | H05B 33/0821 315/185 S |
| 2011/0241551 | A1 * | 10/2011 | McRae | H05B 33/0806 315/130 |

(Continued)

*Primary Examiner* — Wei (Victor) Y Chan
(74) *Attorney, Agent, or Firm* — Buckley, Maschoff & Talwalkar LLC

(57) ABSTRACT

A light emitting diode (LED) lamp includes a primary LED grouping (210,310), a switchable LED grouping (215), and a conduction path selector (240,340) configured to select a conductive path that places the primary LED grouping in electrical series with at least a portion of the switchable LED grouping, or bypasses the switchable LED grouping. The primary LED grouping have a first color temperature rating, and each respective LED subgrouping have a respective color temperature different from the first color temperature. Selection of one or more LED subgrouping results in the LED lamp emitting different color temperatures.

12 Claims, 4 Drawing Sheets

(56) References Cited

U.S. PATENT DOCUMENTS

| | | | | |
|---|---|---|---|---|
| 2013/0002157 | A1* | 1/2013 | van de Ven | H05B 45/46 315/192 |
| 2013/0234596 | A1* | 9/2013 | Hollander | H05B 33/0809 315/90 |
| 2014/0252967 | A1* | 9/2014 | van de Ven | H05B 33/0863 315/188 |
| 2016/0095180 | A1* | 3/2016 | Miskin | H05B 45/30 315/185 R |
| 2016/0255683 | A1* | 9/2016 | Wu | H05B 45/20 315/192 |
| 2016/0273717 | A1* | 9/2016 | Krames | G02F 1/133603 |

* cited by examiner

LED LAMP WITH SELECTABLE COLOR TEMPERATURE OUTPUT

BACKGROUND

Conventional light emitting diode (LED) lamps can include an array of LED light engines. The LED light engine array can be partitioned into groupings of LEDs electrically connected in series, with these serial groupings electrically connected to a driver circuit. Typically, the LED light engines can each have the same correlated color temperature (CCT) rating. To tune the emitted light to a different CCT, the LED lamp must be changed to an LED lamp of a different CCT rating.

FIG. 1 depicts a schematic of conventional LED lamp 100. The conventional LED lamp includes LED array 110 having eleven sets of nine parallel LEDs, electrically connected in series. In some implementations, all the LED light engines can have the same CCT rating. In other implementations, the LED light engines can have different CCT ratings. Current source 120 powers all ninety-nine LED light engines.

In another conventional approach, tunable LED lamps can include a first arrangement of LED light engines emitting light at one CCT, and a second arrangement of LED light engines emitting light at another CCT. The drive electronics for this tunable LED lamp is configured to provide different, and adjustable, drive currents to each of the LED light engine arrangements. The color temperature from this conventional tunable LED lamp can be controlled by the relative magnitude, and/or duty cycle, of the drive currents provided to each arrangement of LED light engines. This conventional approach requires a dual output driver circuit having independent control of the driver outputs' magnitude and/or duty cycle. Also required are specialized electrical terminals, connectors, and luminaire fixtures to accommodate the dual connections between the driver electronics and LED lamp.

What is missing from the art is an LED lamp with a tunable CCT rating, that can be retrofitted into existing light fixtures without the need for specialized driver electronics, wiring, or connections.

DETAILED DESCRIPTION

Embodying devices provide an LED lamp with a tunable CCT rating. An embodying LED lamp can include a primary grouping of LED light engines configured to provide an intermediary CCT rating, one or more switchable LED groupings that include a second grouping of LED light engines configured to provide a second CCT rating (one of higher or lower than the intermediary rating), and a third grouping of LED light engines configured to provide a third CCT rating (the other one of higher or lower than the intermediary rating). A conduction path selector (i.e., a switch, jumper, circuit trace, wire, etc.) is included to respectively connect/isolate one or more of the switchable LED groupings to/from the primary LED grouping. The term "lamp" as used herein can encompass could be a replacement lamp, LED tube, indoor luminaire, outdoor fixture, etc.

The CCT output rating for an embodying LED lamp is determined based on the combined CCT rating of the intermediary LED grouping combined with the first, the second, or both LED groupings selected by operation of the conduction path selector. An embodying LED lamp is not so limited, and other numbers of LED groupings configured to be selectably connected to the intermediary LED group are contemplated by this disclosure.

Figure 1:
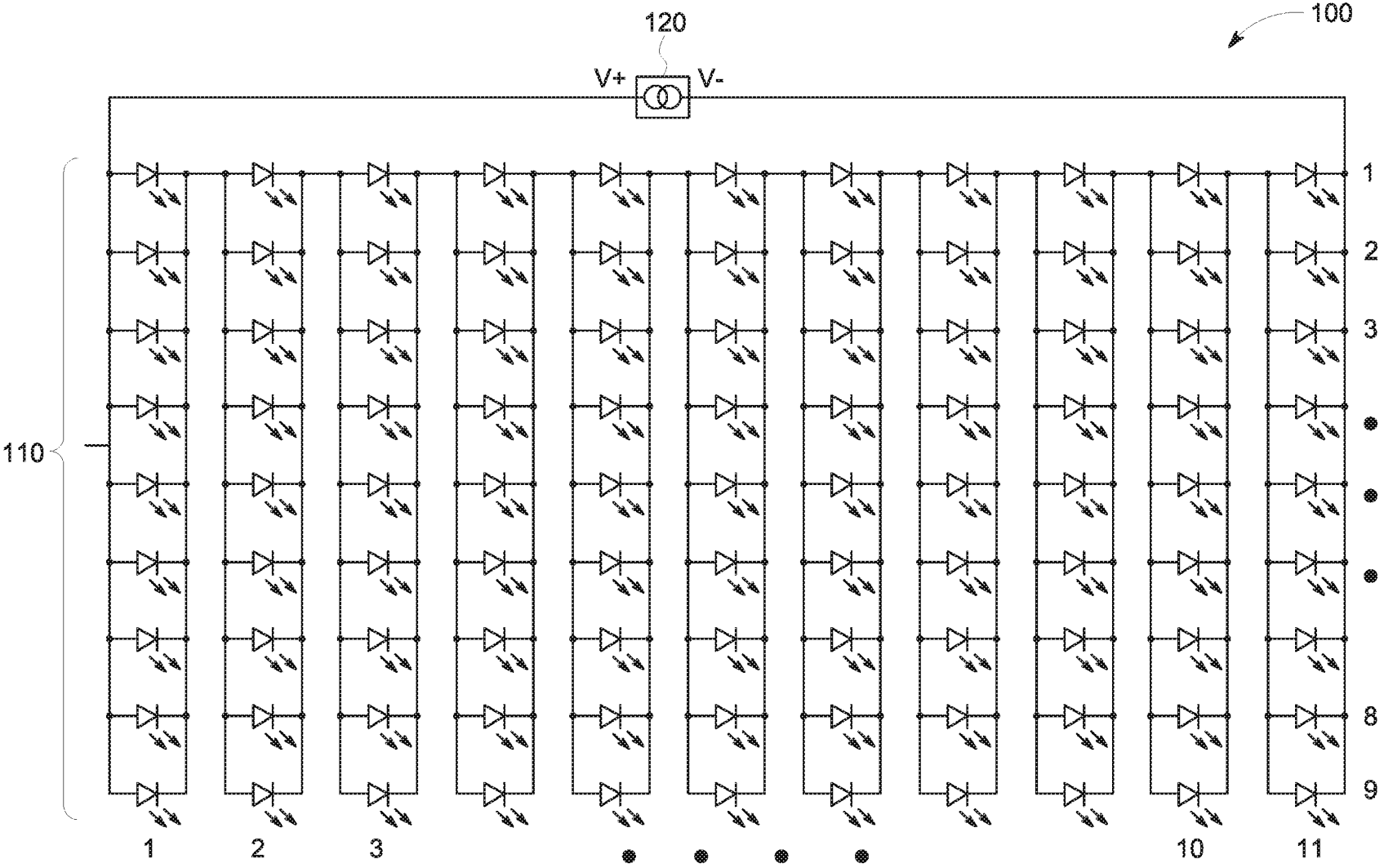
(PRIOR ART) FIG. 1
FIG. 1 schematically depicts a conventional LED lamp.
Figure 2:
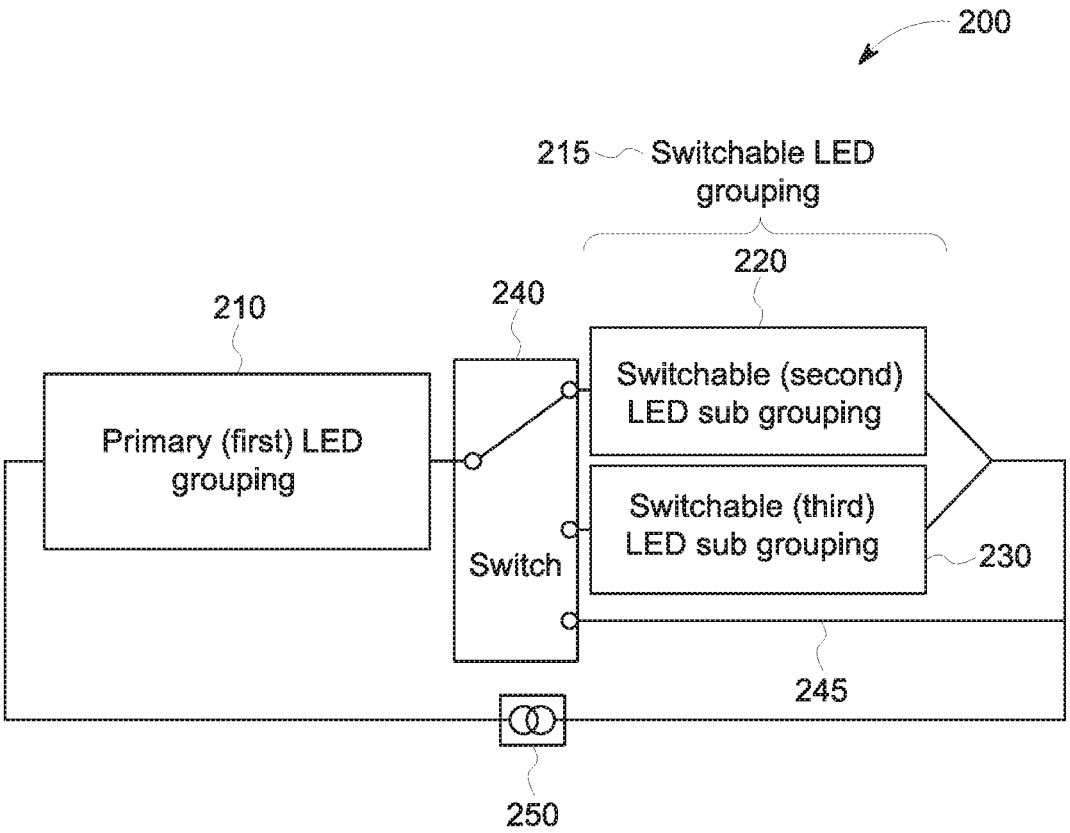
FIG. 2 depicts a block diagram of an LED lamp in accordance with embodiments.

FIG. 2 depicts a block diagram of CCT tunable LED lamp 200 in accordance with embodiments. Primary LED grouping 210 is composed of a plurality of LED light sources that provide a first CCT rating light emission. Switchable LED grouping 215 can include one, two, or more LED groupings that can be selected by operation of the conduction path selector.

For purposes of discussion, LED lamp 200 is depicted with only two switchable LED groupings. It should be readily understood that other amounts of switchable LED groupings are within the contemplation of this disclosure. The switchable LED grouping can also include bypass path 245 (i.e., a short circuit), to bypass each of the LED groupings within the switchable LED grouping.

Second LED grouping 220 is composed of a plurality of LED light sources that provide a second CCT rating light emission. Third LED grouping 230 is composed of a plurality of LED light sources that provide a third CCT rating light emission.

Conduction path selector 240 can be configurable to select one or more of the second or third LED grouping to be connected to electronic driver 250 in conjunction with the primary LED grouping. The conduction path selector can be a switch, jumper, circuit trace, or other simple mechanical device with which an electrical connection can be opened, or closed. By way of example, conduction path selector 240 is depicted as a single-pole, triple-throw switch. Embodiments are not so limited, and other mechanisms and configurations are within the contemplation of this disclosure.

FIG. 2 illustrates a configuration where the selectable groupings are in series with the first grouping. In other implementations, the selectable groupings can be in parallel with the first grouping. The LED light sources within each LED grouping can have the same, or different, CCT rating as other LED sources within that grouping. In accordance with embodiments, switching a LED grouping into the circuit with the primary LED grouping results in a combined CCT rating for LED lamp 200.

In accordance with embodiments, the LED lamp can be adjusted to emit one of two or more selectable color temperatures. In some implementations, the selected color temperature can be achieved from combining illumination from about the same overall quantity of LED light sources as a conventional, single color temperature LED lamp. In other implementations, there can be a minimal increase in the quantity of active LED light sources. By restraining the quantity of active LEDs to be about, or minimally, the same as a conventional LED lamp, embodying LED lamps can be retrofitted into existing troffers, fixtures, and luminaires without a need to change out the electronic driver powering the LED lamp.

Each of the first, second, and third LED groupings provide a different color temperature. If the primary LED grouping has a color temperature intermediate to the second and third LED grouping, then the combination of the first with one of the second or third LED groupings results in a net CCT rating either above or below the first group's intermediate CCT rating.

In accordance with embodiments, the primary LED grouping can have a quantity of LED light sources greater than the quantity of LED light sources in the other LED groupings (which themselves need not have an equal number of LED light sources). Because the illuminated LEDs of an embodying lamp are about the same number as illuminated by a conventional LED lamp, loading of the electronic driver remains about the same. By replacing a conventional LED lamp with an embodying LED lamp, the existing electronic driver can be retained.

For purposes of discussion, in accordance with embodiments, a LED lamp can include a first quantity of intermediate rated CCT LED light sources (for example, having an average group CCT rating of 3750 K); a second quantity of lower rated CCT LED light sources (for example, having an average group CCT rating of 2700 K); and a third quantity of higher rated CCT LED light sources (for example, having an average group CCT rating of 5000 K)—where the first quantity is greater than both the second and third quantities, and where the second and third quantities need not be equal. By operation of a conduction path selector, either the nominally 5000 K LEDs or the nominally 2700 K LEDs are put in series with the nominally 3750K LEDs. The resulting overall CCT rating of the LED lamp's emission is either about 3500K or about 4000K, depending on whether the lower CCT LED light sources or the higher CCT LED light sources are placed in series, respectively. If both contacts are closed, then both the 5000 K and 2700 K LEDs are illuminated at lower levels, resulting in the fixture emitting very near to the intermediate CCT rating (3750K). Alternatively, in one implementation both the 5000K and 2700K LED light sources can be bypassed (i.e., not illuminated at all), resulting in the fixture emitting very near to the intermediate CCT rating (3750K).

Figure 3:
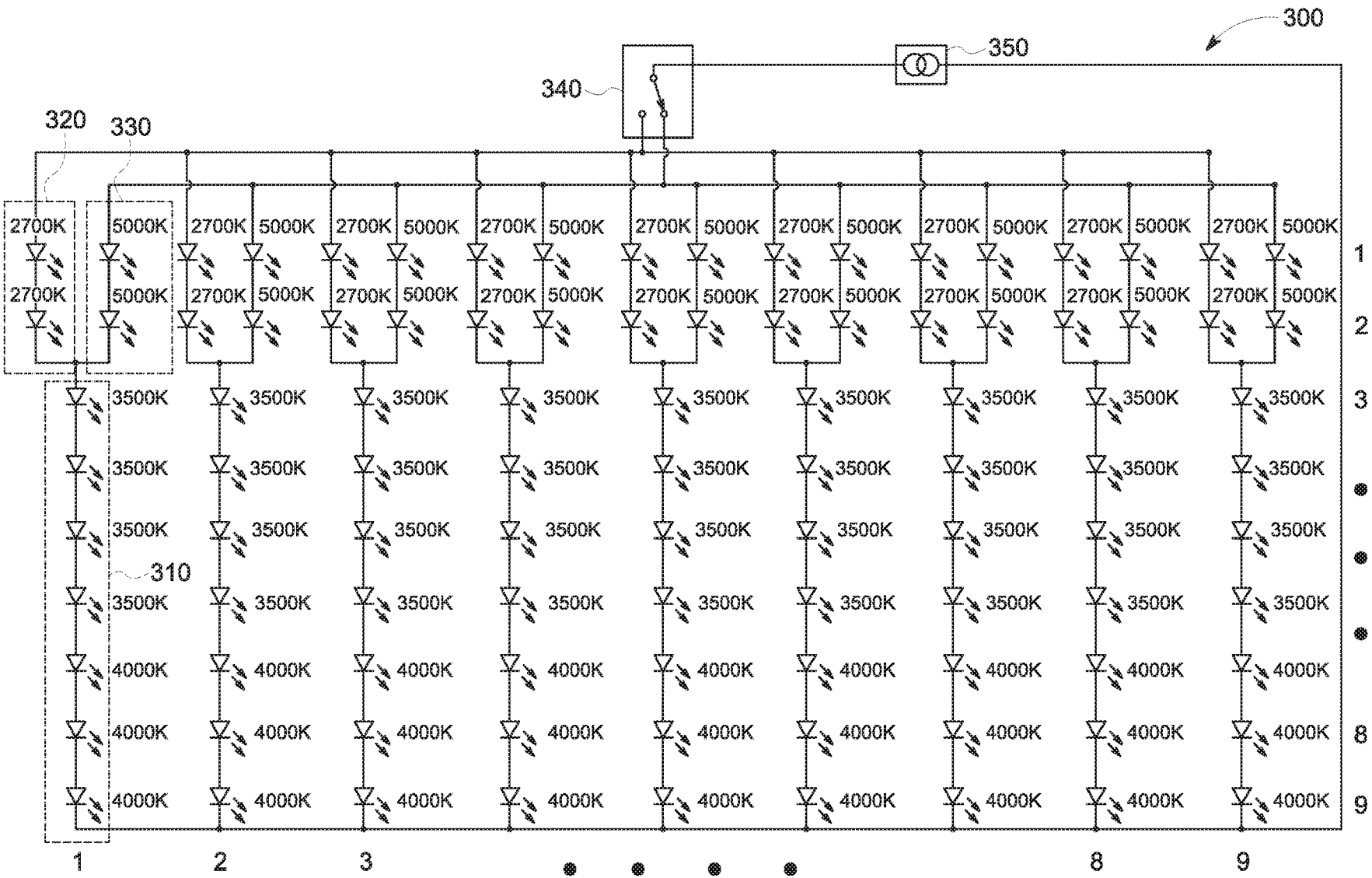
FIG. 3 schematically depicts an LED lamp in accordance with embodiments.

FIG. 3 schematically depicts LED lamp 300 in accordance with embodiments. Primary LED grouping 310 is composed of a plurality of LED light sources that provide a first CCT rating light emission. As illustrated, the primary LED grouping includes LED light sources color rated at 3500K, and light sources rated at 4000K—resulting in an overall group color rating of about 3710K. Second LED grouping 320 is composed of a plurality of LED light sources with a second CCT rating (e.g., a color rating of 2700K). Third LED grouping 330 is composed of a plurality of LED light sources with a third CCT rating (e.g., a color rating of 5000K).

In accordance with embodiments, as with the primary LED grouping, within the second and third LED groupings can be LEDs of different color ratings, so that a group color rating for each of the LED groups is the net of the different LED ratings within each specific group.

Conduction path selector 340 can introduce either second LED grouping 320 (having a color rating lower than the intermediate rating), or third LED grouping 330 (having a color rating higher than the intermediate rating) in series with primary LED grouping 310. The resultant combination of illuminated LEDs will have a cumulative color rating of either lesser or greater than the intermediate color rating of the primary LED grouping. In accordance with embodiments, the conduction path selector can be configured to bypass both the second and third LED groupings, so that just the primary LED grouping is connected to electronic driver 340.

In accordance with embodiments, LED lamp 300 can include more than two LED groupings that are selectable by the conduction path selector to be placed in series with the primary LED grouping. Accordingly, an embodying LED lamp can emit illumination with one of two, three, or more CCT ratings—at no or minimal additional cost compared to a traditional fixture, which can emit illumination having only one CCT rating.

LED lamp 300 is illustrated as including ninety-nine LED light sources arranged in a 9 row×9 column rectangular matrix, where the LEDs of the second and third groupings are illustrated as being positioned in the same rows. Other quantities of LED light sources, and matrices (e.g., diamond, triangular, higher-order polygonal, circular, etc.) are within the scope of this disclosure.

Figure 4:
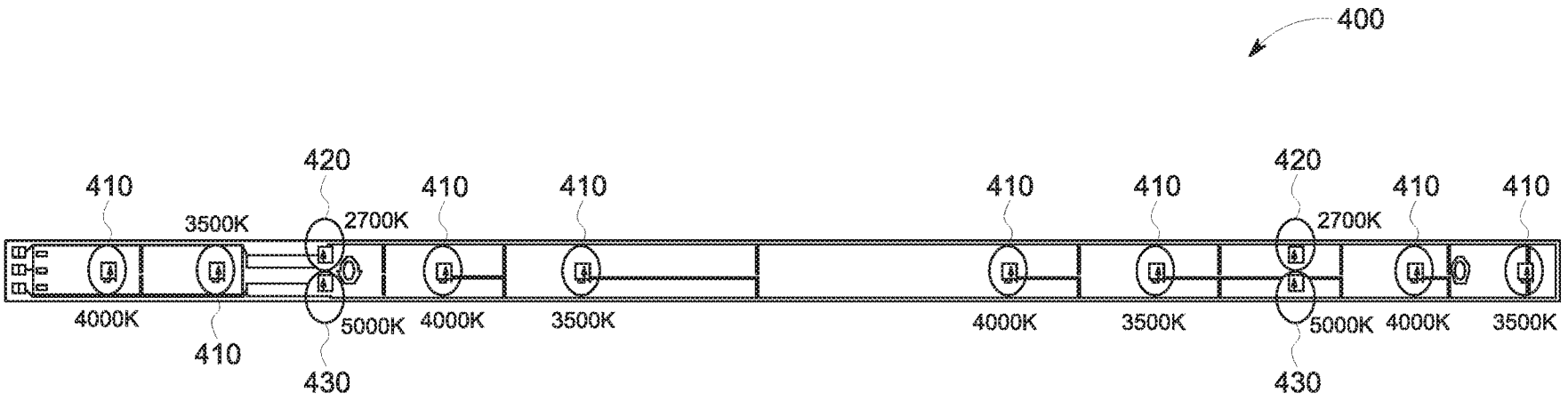
FIG. 4 depicts a printed circuit board for the LED lamp of FIG. 3 in accordance with embodiments.

FIG. 4 depicts printed circuit board 400 for LED lamp 300 in accordance with embodiments. In accordance with embodiments, the LED light sources of different groupings can be positionally distributed in an interleaved arrangement so that LED light sources of the same color ratings are located throughout the LED lamp. For example, LED light sources 410 are from primary LED grouping 310; LED light sources 420 are from second LED grouping 320; and LED light sources 430 are from third LED grouping 330. This interleaved arrangement can provide a homogenous, uniform emitted light from the LED lamp resulting in an improved light mixing.

Table I presents operating characteristics for prior art LED lamp 100 and two selectable configurations of embodying LED lamp 300.

TABLE I

| | LED LAMP 100 (PRIOR ART) | LED LAMP 300 (second group selected) | LED LAMP 300 (third group selected) |
|---|---|---|---|
| LED (qty@ CCT rating) | 99 total @ 3500K | 81 total: 36@3500K; 27@4000K; 18@2700K | 81 total: 36@3500K; 27@4000K; 18@5000K |
| If (mA) | 90 | 110 | 110 |
| Flux (Lm) | 3476 | 3501 | 3629 |
| CCT | 3511 | 3482 | 4033 |
| Duv | 0.0021 | 0.0007 | 0.0016 |
| LPW | 136 | 134 | 139 |

Prior art LED lamp 100 (in which 99 LEDs of 3500 K CCT are arrayed), draws a linefeed current (If) of 90 mA (from eleven strings of nine LED light sources), yielding a flux (in lumens) of 3476, a color temperature of 3511K, an efficiency of 136 LPW (lumens per watt), and a distance to the blackbody locus (Duv) of 0.0021.

Embodying LED lamp 300 (with 81 illuminated LED light sources in a first configuration—first group 310 and second group 320), draws a linefeed current of about 110 mA (higher because this is nine strings of nine LED light sources), the tunable light engine is configured to emit a color temperature of about 3482K, a comparable flux of about 3501 lumens, a comparable efficiency of about 134 LPW, and a slightly shifted distance to the blackbody locus (Duv) of about 0.0007.

Embodying LED lamp 300 (with 81 illuminated LED light sources in a second configuration—first group 310 and third group 330), draws the same linefeed current of about 110 mA, the tunable light engine is configured to emit a color temperature of about 4033K, a flux of about 3629 lumens, a comparable efficiency of about 139 LPW, and a distance to the blackbody locus (Duv) of 0.0016.

An embodying LED lamp provides flexibility in configuring the color temperature of the lamp. This flexibility could allow manufacturers, distributors, and end users from having multiple lamps by replacing them with one embodying LED lamp, which can be configured to match the illumination color of the conventional lamps.

Although specific hardware and methods have been described herein, note that any number of other configurations may be provided in accordance with embodiments of the invention. Thus, while there have been shown, described, and pointed out fundamental novel features of the invention, it will be understood that various omissions, substitutions, and changes in the form and details of the illustrated embodiments, and in their operation, may be made by those skilled in the art without departing from the spirit and scope of the invention. Substitutions of elements from one embodiment to another are also fully intended and contemplated. The invention is defined solely with regard to the claims appended hereto, and equivalents of the recitations therein.

We claim:

1. A color correlated temperature (CCT) tunable LED lamp comprising:

a primary LED grouping including a plurality of LED light sources that provide a first net CCT rating light emission, wherein the primary LED grouping comprises:

a first LED light subgrouping of one or more LED light sources each providing a first CCT rating light emission, and at least a second LED light subgrouping of one or more LED light sources each providing a second CCT rating light emission, the second CCT rating light emission being different from the first CCT rating light emission;

switchable LED groupings comprising at least (i) a second LED grouping of a plurality of LED light sources providing a second net CCT rating light emission, and (ii) a third LED grouping of a plurality of LED light sources providing a third net CCT rating light emission; and a conduction path selector to respectively connect or isolate one or more of the second LED grouping and third LED grouping to or from the primary LED grouping, the second net CCT rating is greater than the first net CCT rating, and the third net CCT rating is lower than the first net CCT rating; and individual ones of the plurality of LED light sources of the primary LED grouping, individual ones of the plurality of LED light sources of the second LED grouping, and individual ones of the plurality of LED light sources of the third LED grouping are positionally distributed in an interleaved arrangement so that LED light sources of the primary, the second, and the third LED grouping are located throughout the LED lamp.

2. The CCT tunable LED lamp of claim 1, including:

the primary LED grouping having a first quantity of LED light sources; and each of the switchable LED groupings having a quantity of LED light sources such that the first quantity is greater than the quantity of LED light sources in each of the switchable LED groupings.

3. The CCT tunable LED lamp of claim 1, wherein the conduction path selector is configured to select a conductive path that places the primary LED grouping in electrical series with at least one of the second LED grouping and the third LED grouping.

4. The CCT tunable LED lamp of claim 1, wherein at least some LED light sources in the primary LED grouping have different CCT ratings from each other, and the first net CCT rating is the net of the different CCT ratings within the primary LED grouping.

5. The CCT tunable LED lamp of claim 1, wherein at least some LED light sources in the second LED grouping have different CCT ratings from each other, and the second net CCT rating is the net of the different CCT ratings within the second LED grouping.

6. The CCT tunable LED lamp of claim 1, wherein at least some LED light sources in the third LED grouping have different CCT ratings from each other, and the third net CCT rating is the net of the different CCT ratings within the third LED grouping.

7. The CCT tunable LED lamp of claim 1, wherein the CCT tunable LED lamp includes one electronic driver for driving the primary LED grouping and the switchable LED groupings.

8. A lamp, comprising:

a primary light emitting diode (LED) grouping, the primary LED grouping having a first quantity of LED light sources, the primary LED grouping providing a first net color temperature, wherein the primary LED grouping comprises:

a first LED light subgrouping of one or more LED light sources each providing a first color temperature, and at least a second LED light subgrouping of one or more LED light sources each providing a second color temperature, the second color temperature being different from the first color temperature;

a switchable LED grouping including at least:

(i) a third LED subgrouping, the third LED subgrouping having a second quantity of LED light sources, the third LED subgrouping providing a second net color temperature lower than the first net color temperature, and (ii) a fourth LED subgrouping, the fourth LED subgrouping having a third quantity of LED light sources, the fourth LED subgrouping providing a third net color temperature greater than the first net color temperature, wherein the first quantity of LED light sources is greater than the second quantity of LED light sources and the first quantity of LED light sources is greater than the third quantity of LED light sources; and a conduction path selector to one of (i) serially connect at least one of the third LED subgrouping and the fourth LED subgrouping to the primary LED grouping, and (ii) disconnect both the third LED subgrouping and the fourth LED subgrouping from the primary LED grouping.

9. The lamp of claim 8, wherein the lamp is one of a replacement lamp, a LED tube, an indoor luminaire and an outdoor fixture.

10. The lamp of claim 8, wherein at least some LED light sources in the primary LED grouping have different net color temperature ratings from each other, and the first net color temperature rating is the net of the different color temperature ratings within the primary LED grouping.

11. The lamp of claim 8, wherein at least some LED light sources in the third LED subgrouping have different net color temperature ratings from each other, and the second net color temperature rating is the net of the different net color temperature ratings within the third LED subgrouping.

12. The lamp of claim 8, wherein at least some LED light sources in the fourth LED subgrouping have different net color temperature ratings from each other, and the third net color temperature rating is the net of the different net color temperature ratings within the fourth LED subgrouping.

* * * * *